US011728605B2

(12) United States Patent
Xiao et al.

(10) Patent No.: US 11,728,605 B2
(45) Date of Patent: Aug. 15, 2023

(54) ROTARY ELECTRICAL CONNECTION ASSEMBLY

(71) Applicant: SHENZHEN FENDA TECHNOLOGY CO., LTD, Shenzhen (CN)

(72) Inventors: Yong Xiao, Shenzhen (CN); Mianjia Wei, Shenzhen (CN)

(73) Assignee: SHENZHEN FENDA TECHNOLOGY CO., LTD., Shenzhen (CN)

( * ) Notice: Subject to any disclaimer, the term of this patent is extended or adjusted under 35 U.S.C. 154(b) by 96 days.

(21) Appl. No.: 17/377,418

(22) Filed: Jul. 16, 2021

(65) Prior Publication Data

US 2022/0021167 A1 Jan. 20, 2022

(30) Foreign Application Priority Data

Jul. 17, 2020 (CN) ..... 202021423025.X

(51) Int. Cl.
*H01R 35/00* (2006.01)
*H01R 13/40* (2006.01)
*A45D 1/04* (2006.01)

(52) U.S. Cl.
CPC ..... *H01R 35/00* (2013.01); *A45D 1/04* (2013.01); *H01R 13/40* (2013.01)

(58) Field of Classification Search
CPC ..... H01R 35/04; H01R 35/00; A45D 1/04; A45D 20/12
See application file for complete search history.

(56) References Cited

U.S. PATENT DOCUMENTS 7,192,303 B2 * 3/2007 Kohen ..... H02G 3/20 439/537
7,458,814 B2 * 12/2008 Hur ..... H01R 43/20 439/21

* cited by examiner

*Primary Examiner* — Oscar C Jimenez
*Assistant Examiner* — Paul D Baillargeon

(57) ABSTRACT

The present invention discloses a rotary electrical connection assembly. The rotary electrical connection assembly includes: a fixed part disposed fixedly and a rotating part disposed rotatably relative to the fixed part. The rotating part is provided with at least two rotary contacts. In the rotary electrical connection assembly provided in the present invention, provided that more groups of the rotary contacts and the fixed contacts are disposed, at least some of the contacts may be disposed at different radial positions corresponding to the same axial position without additionally occupying an axial dimension space, and therefore the increase of an axial dimension of a device may be avoided, and miniaturization of the device is facilitated.

18 Claims, 6 Drawing Sheets

--Prior Art--

--Prior Art--

ROTARY ELECTRICAL CONNECTION ASSEMBLY

TECHNICAL FIELD

The present invention relates to the technical field of hair styling products, and in particular, to a rotary electrical connection assembly. In addition, the present invention further relates to a rotary tail assembly including the rotary electrical connection assembly, and a hair styling device including the rotary electrical connection assembly or the rotary tail assembly.

BACKGROUND

To realize a hair styling effect, existing hairdressing products need to heat hair and rotate a heating member to wind the hair around the surface of the heating member. The heating member is disposed in a rotating part, and the rotating part is disposed rotatably relative to a body and connected to the body through a connector.

Patent 200920113044.X provides an improved hair straightener. As shown in FIG. 1, a rotary electrical connection assembly is disposed in the improved hair straightener. The rotary electrical connection assembly includes a cylindrical rotary tail base. A rear end of the rotary tail base is rotatably connected to a power line connector. A positive pole piece and a negative pole piece are mounted in the rotary tail base. The positive pole piece and the negative pole piece each are a non-closed annular electrical contact 01. Closed annular electrical contacts 02 are disposed at one end of a power line. The closed annular electrical contacts 02 are axially graded and distributed in a stepped manner. The positive pole piece and the negative pole piece are respectively in contact with different annular electrical contacts. Due to this arrangement mode, provided that there are a larger number of poles in an electrode, multiple groups of different closed annular contacts need to be axially disposed, consequently a length of the rotary electrical connection assembly is increased, and miniaturization of a product is not facilitated.

In conclusion, how to provide a rotary electrical connection assembly capable of reducing a length of a product is the problem urgently needing to be solved by a person skilled in the art currently.

SUMMARY

In view of this, an objective of the present invention is to provide a rotary electrical connection assembly. In the rotary electrical connection assembly, a sleeved manner is used between rotary closed contacts and fixed non-closed contacts, between rotary non-closed contacts and fixed closed contacts, between rotary closed contacts and rotary non-closed contacts, and between fixed closed contacts and fixed non-closed contacts separately. Provided that more groups of the rotary non-closed contacts, the fixed closed contacts, the rotary closed contacts and the fixed non-closed contacts are disposed, the increase of an axial dimension of a device may be avoided, and miniaturization of the device is facilitated.

Another objective of the present invention is to provide a rotary tail assembly including the rotary electrical connection assembly, and a hair styling device including the rotary electrical connection assembly or the rotary tail assembly.

To achieve the above objectives, the present invention provides the following technical solutions.

A rotary electrical connection assembly includes: a fixed part disposed fixedly and a rotating part disposed rotatably relative to the fixed part, where the rotating part is provided with at least two rotary contacts, the fixed part is provided with at least two fixed contacts, the at least two rotary contacts are located at different radial positions corresponding to the same axial position, and/or the at least two fixed contacts are located at different radial positions corresponding to the same axial position; and the fixed contacts and the rotary contacts are electrically connected.

Preferably, the rotating part is provided with an even number of the rotary contacts, and the fixed part is provided with an even number of the fixed contacts.

Preferably, the rotary contacts include at least two rotary closed contacts and at least two rotary non-closed contacts, and the fixed contacts include at least two fixed closed contacts and at least two fixed non-closed contacts; and the rotary closed contacts and the fixed non-closed contacts are electrically connected in a correspondingly sleeved manner, and the rotary non-closed contacts and the fixed closed contacts are electrically connected in a correspondingly sleeved manner.

Preferably, the rotary closed contacts and the rotary non-closed contacts are disposed in a one-to-one correspondence manner, the rotary closed contacts and the rotary non-closed contacts corresponding thereto are located at different radial positions corresponding to the same axial position, and different rotary closed contacts are located at different axial positions;

and/or the fixed closed contacts and the fixed non-closed contacts are disposed in a one-to-one correspondence manner, the fixed closed contacts and the fixed non-closed contacts corresponding thereto are located at different radial positions corresponding to the same axial position, and different fixed closed contacts are located at different axial positions.

Preferably, an axial width of the rotary non-closed contacts, an axial width of the rotary closed contacts (1), an axial width of the fixed non-closed contacts and an axial width of the fixed closed contacts (3) all are the same; and an axial gap between the rotary closed contacts disposed axially adjacently and an axial gap between the fixed closed contacts disposed axially adjacently are the same.

Preferably, the rotary contacts include at least one rotary closed contact and at least one rotary non-closed contact, and the fixed contacts include at least one fixed closed contact and at least one fixed non-closed contact;

the rotary closed contacts and the fixed non-closed contacts are electrically connected in a correspondingly sleeved manner, and the rotary non-closed contacts and the fixed closed contacts are electrically connected in a correspondingly sleeved manner; and the rotary closed contacts and the rotary non-closed contacts are located at different radial positions corresponding to the same axial position, and the fixed closed contacts and the fixed non-closed contacts are located at different radial positions corresponding to the same axial position.

Preferably, an axial width of the rotary non-closed contacts, an axial width of the rotary closed contacts, an axial width of the fixed non-closed contacts and an axial width of the fixed closed contacts all are the same; and the rotary non-closed contacts, the rotary closed contacts, the fixed non-closed contacts and the fixed closed contacts axially completely coincide.

Preferably, the rotary non-closed contacts and the fixed non-closed contacts each are an elastic structural member, such that the rotary non-closed contacts are in contact with sides of the fixed closed contacts by elastic force, and the fixed non-closed contacts are in contact with sides of the rotary closed contacts by elastic force.

Preferably, the rotary non-closed contacts, the rotary closed contacts, the fixed non-closed contacts and the fixed closed contacts each have a sheet structure.

Preferably, the rotary closed contacts and the rotary non-closed contacts each are provided with a first bent part electrically connected to a rotating member, and the fixed non-closed contacts and the fixed closed contacts each are provided with a second bent part electrically connected to a power supply part.

A rotary tail assembly includes the rotary electrical connection assembly described in any one of the above.

A hair styling device includes the rotary electrical connection assembly described in any one of the above or the rotary tail assembly.

When the rotary electrical connection assembly provided in the present invention is used, the rotating part is provided with at least two rotary contacts, and the fixed part is provided with at least two fixed contacts. During the connection process, the rotary contacts and the fixed contacts are electrically connected, to form at least one loop for providing electric energy for components and parts. In addition, the at least two rotary contacts are located at different radial positions corresponding to the same axial position, and/or the at least two fixed contacts are located at different radial positions corresponding to the same axial position. Therefore, provided that more groups of the rotary contacts and the fixed contacts are disposed, a relatively small axial space may be occupied, a radial space may be reasonably utilized, the increase of an axial dimension of the device may be avoided, and miniaturization of the device is facilitated.

In addition, the present invention further provides the rotary tail assembly including the rotary electrical connection assembly, and the hair styling device including the rotary electrical connection assembly or the rotary tail assembly.

BRIEF DESCRIPTION OF DRAWINGS

To describe the technical solutions in the embodiments of the present invention or in the prior art more clearly, the following briefly describes the accompanying drawings required for describing the embodiments or the prior art. Apparently, the accompanying drawings in the following description merely show some embodiments of the present invention, and a person of ordinary skill in the art may still derive other accompanying drawings from these accompanying drawings without creative efforts.

In FIG. 1 to FIG. 8:

01: non-closed annular electrical contact, 02: closed annular electrical contact, 1: rotary closed contact, 2: rotary non-closed contact, 3: fixed closed contact, 4: fixed non-closed contact, 5: rotating housing, 6: fixed housing, 7: central shaft, 8: control button, 9: limiting bearing, 10: motor, and 11: circuit board.

DESCRIPTION OF EMBODIMENTS

The following clearly and completely describes the technical solutions in the embodiments of the present invention with reference to the accompanying drawings in the embodiments of the present invention. Apparently, the described embodiments are merely some but not all of the embodiments of the present invention. All other embodiments obtained by a person of ordinary skill in the art based on the embodiments of the present invention without creative efforts shall fall within the protection scope of the present invention.

A core of the present invention is to provide a rotary electrical connection assembly. Provided that more groups of the rotary non-closed contacts, the fixed closed contacts, the rotary closed contacts and the fixed non-closed contacts are disposed, the increase of an axial dimension of a device may be avoided, and miniaturization of the device is facilitated. Another core of the present invention is to provide a rotary tail assembly including the rotary electrical connection assembly, and a hair styling device including the rotary electrical connection assembly or the rotary tail assembly.

Figure 1:
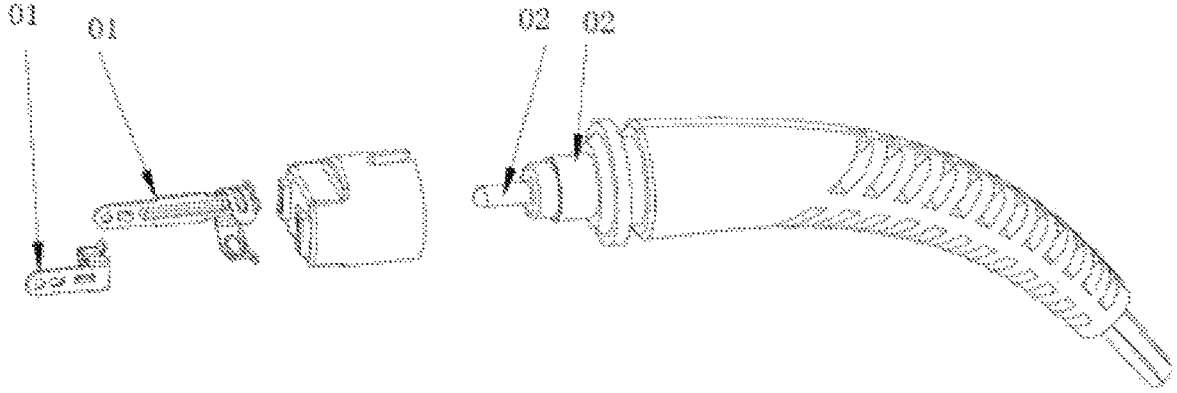
FIG. 1 is a schematic exploded view of a design solution of a rotary electrical connection assembly in the prior art.
Figure 2:
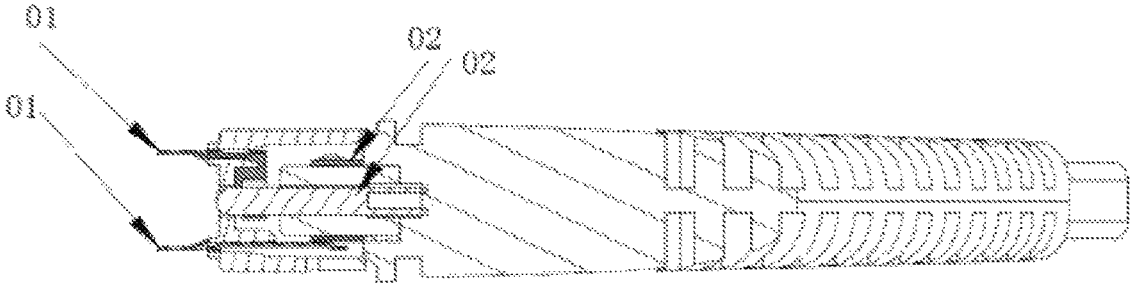
FIG. 2 is a schematic diagram of a partial section after assembly of a rotary electrical connection assembly in FIG. 1.
Figure 3:
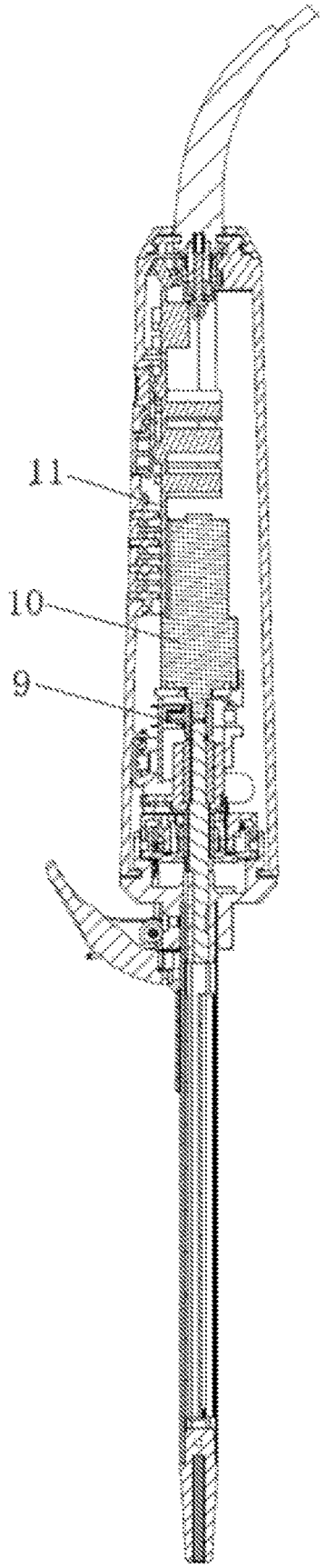
FIG. 3 is a schematic structural diagram of a section of a specific embodiment of a hair styling device provided in the present invention.
Figure 4:
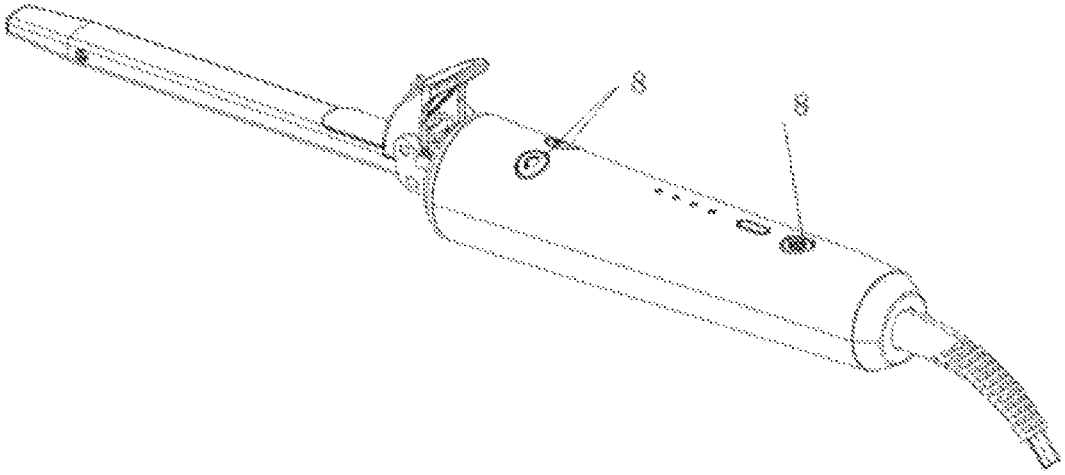
FIG. 4 is a schematic structural diagram of an appearance of a hair styling device provided in the present invention.
Figure 5:
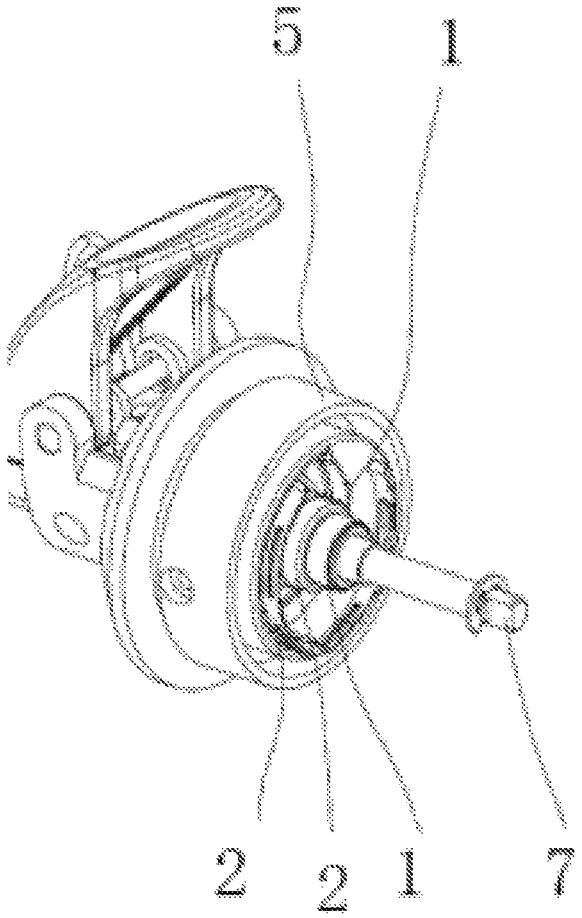
FIG. 5 is a schematic structural diagram of a specific embodiment of a rotating part in a rotary electrical connection assembly provided in the present invention.
Figure 6:
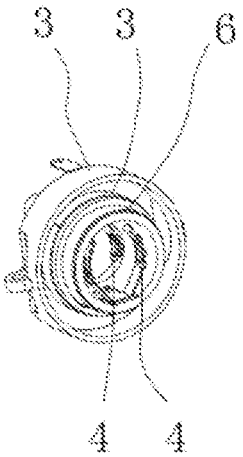
FIG. 6 is a schematic structural diagram of a specific embodiment of a fixed part in a rotary electrical connection assembly provided in the present invention.
Figure 7:
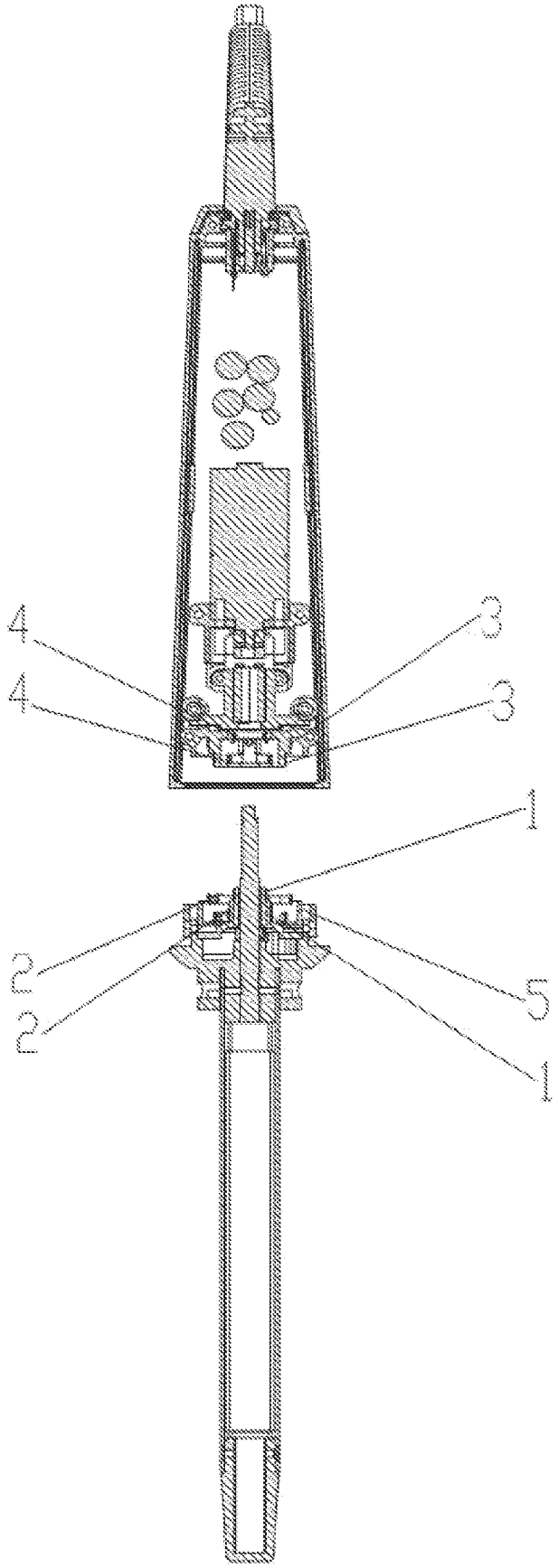
FIG. 7 is a schematic structural diagram of a section of a specific embodiment of a hair styling device provided in the present invention from another angle.
Figure 8:
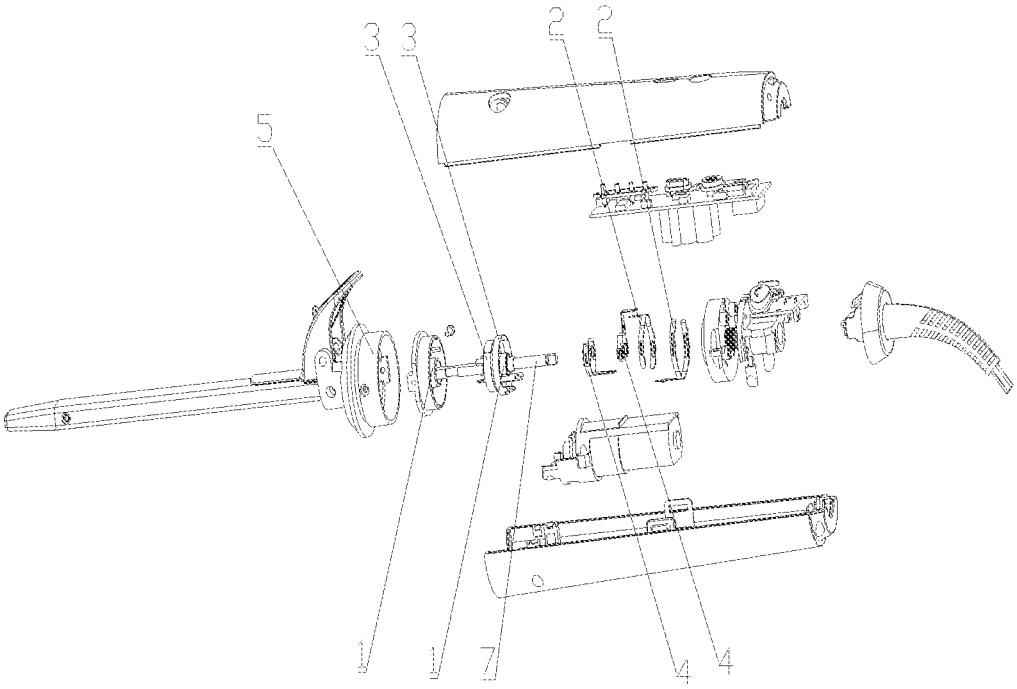
FIG. 8 is an exploded view of a hair styling device provided in the present invention.

With reference to FIG. 1 to FIG. 8, FIG. 1 is a schematic exploded view of a design solution of a rotary electrical connection assembly in the prior art; FIG. 2 is a schematic diagram of a partial section after assembly of a rotary electrical connection assembly in FIG. 1; FIG. 3 is a schematic structural diagram of a section of a specific embodiment of a hair styling device provided in the present invention; FIG. 4 is a schematic structural diagram of an appearance of a hair styling device provided in the present invention; FIG. 5 is a schematic structural diagram of a specific embodiment of a rotating part in a rotary electrical connection assembly provided in the present invention; FIG. 6 is a schematic structural diagram of a specific embodiment of a fixed part in a rotary electrical connection assembly provided in the present invention; FIG. 7 is a schematic structural diagram of a section of a specific embodiment of a hair styling device provided in the present invention from another angle; and FIG. 8 is an exploded view of a hair styling device provided in the present invention.

A rotary electrical connection assembly provided in this specific embodiment includes: a fixed part disposed fixedly and a rotating part disposed rotatably relative to the fixed part, where the rotating part is provided with at least two rotary contacts, at least two fixed contacts being disposed on the fixed part, the at least two rotary contacts are located at different radial positions corresponding to the same axial position, and/or the at least two fixed contacts are located at different radial positions corresponding to the same axial position; and the fixed contacts and the rotary contacts are electrically connected.

The rotary contacts may be rotary closed contacts 1, may further be rotary non-closed contacts 2, or have a combined structure of the two, and the fixed contacts may be fixed closed contacts 3, may further be fixed non-closed contacts 4, or have a combined structure of the two, which is determined specifically according to actual situations.

In use, the rotating part is provided with at least two rotary contacts, and the fixed part is provided with at least two fixed contacts. During the connection process, the rotary contacts and the fixed contacts are electrically connected, to form at least one loop for providing electric energy for components and parts. In addition, the at least two rotary contacts are located at different radial positions corresponding to the same axial position, and/or the at least two fixed contacts are located at different radial positions corresponding to the same axial position. Therefore, provided that more groups of the rotary contacts and the fixed contacts are disposed, a relatively small axial space may be occupied, a radial space may be reasonably utilized, the increase of an axial dimension of a device may be avoided, and miniaturization of the device is facilitated.

In this specific embodiment, the rotating part is provided with an even number of the rotary contacts, and the fixed part is provided with an even number of the fixed contacts. Specifically, there may be two, four, six or a greater even number of rotary contacts and fixed contacts, which is not limited in the present application. The rotary contacts may be one rotary closed contact 1 and one rotary non-closed contact 2, may further be an even number of rotary closed contacts and an even number of rotary non-closed contacts 2, and certainly may further be either an even number of rotary closed contacts 1 or an even number of rotary non-closed contacts 2 provided that the total number of the rotary contacts is an even number, and the fixed contacts may be one fixed closed contact 3 and one fixed non-closed contact 4, may further be an even number of fixed closed contacts 3 and an even number of fixed non-closed contacts 4, and certainly may further be either an even number of fixed closed contacts 3 or an even number of fixed non-closed contacts 4 provided that the total number of the fixed contacts is an even number, which is not limited in the present application.

During the connection process, the rotary contacts and the fixed contacts are electrically connected, to form at least one loop for providing electric energy for components and parts. In addition, an even number of the rotary contacts are located at different radial positions corresponding to the same axial position, and/or at least an even number of the fixed contacts are located at different radial positions corresponding to the same axial position. Provided that more groups of the rotary contacts and the fixed contacts are disposed, a relatively small axial space may be occupied, a radial space may be reasonably utilized, the increase of an axial dimension of a device may be avoided, and miniaturization of the device is facilitated.

On the basis of the above embodiments, the rotary contacts may include at least two rotary closed contacts 1 and at least two rotary non-closed contacts 2, the rotary closed contacts 1 and the rotary non-closed contacts 2 are disposed in a one-to-one correspondence manner, the rotary closed contacts 1 and the rotary non-closed contacts 2 corresponding thereto are located at different radial positions corresponding to the same axial position, and different rotary closed contacts 1 are located at different axial positions; and/or the fixed contacts include at least two fixed closed contacts 3 and at least two fixed non-closed contacts 4, the fixed closed contacts 3 and the fixed non-closed contacts 4 are disposed in a one-to-one correspondence manner, the fixed closed contacts 3 and the fixed non-closed contacts 4 corresponding thereto are located at different radial positions corresponding to the same axial position, and different fixed closed contacts 3 are located at different axial positions.

During the arrangement process of the rotary contacts and the fixed contacts, the arrangement mode mentioned in this specific embodiment enables dimensions occupied axially and radially by the rotary contacts and the fixed contacts to be more reasonable, and avoids the excessive increase of a dimension in a single direction. Certainly, during the arrangement process, the arrangement mode of the rotary contacts and the fixed contacts may further be adjusted according to actual situations, e.g., two groups of rotary closed contacts 1 and two groups of rotary non-closed contacts 2 are located at different radial positions corresponding to the same axial position respectively, which is determined specifically according to actual situations.

Preferably, an axial width of the rotary non-closed contacts 2, an axial width of the rotary closed contacts 1, an axial width of the fixed non-closed contacts 4 and an axial width of the fixed closed contacts 3 all are the same; and an axial gap between the rotary closed contacts 1 disposed axially adjacently and an axial gap between the fixed closed contacts 3 disposed axially adjacently are the same.

On the basis of the above embodiments, a rotary electrical connection assembly provided in this specific embodiment includes: a fixed part disposed fixedly and a rotating part disposed rotatably relative to the fixed part, where the rotating part is provided with at least one rotary closed contact 1 and at least one rotary non-closed contact 2, and the fixed part is provided with at least one fixed closed contact 3 and at least one fixed non-closed contact 4; the rotary closed contacts 1 and the fixed non-closed contacts 4 are electrically connected in a correspondingly sleeved manner, and the rotary non-closed contacts 2 and the fixed closed contacts 3 are electrically connected in a correspondingly sleeved manner; and the rotary closed contacts 1 and the rotary non-closed contacts 2 are located at different radial positions corresponding to the same axial position, and the fixed closed contacts 3 and the fixed non-closed contacts 4 are located at different radial positions corresponding to the same axial position.

It should be noted that, that the rotary closed contacts 1 and the fixed non-closed contacts 4 are electrically connected in a correspondingly sleeved manner means that during the actual assembly process, in general, one rotary closed contact 1 and one fixed non-closed contact 4 are connected in a sleeved manner, i.e., any one sleeves the periphery of the other. In addition, to guarantee the power-on, the rotary closed contacts 1 and the fixed non-closed contacts 4 need to be electrically connected, and the rotary closed contacts 1 and the fixed non-closed contacts 4 may be electrically connected in a contact manner, and certainly may further be electrically connected in other manners, which is determined specifically according to actual situations. The rotary non-closed contacts 2 and the fixed closed contacts 3 are electrically connected in a correspondingly sleeved manner. In general, one rotary non-closed contact 2 and one fixed closed contact 3 are connected in a sleeved manner, and any one may sleeve the periphery of the other to implement electrical connection.

In addition, to reduce an axial length of the rotary electrical connection assembly as much as possible, during the arrangement process, the rotary closed contacts 1 and the rotary non-closed contacts 2 in the rotating part need to be disposed in a sleeved manner. This means that all the rotary closed contacts 1 and all the rotary non-closed contacts 2 in the rotating part are disposed in a sleeved manner, e.g., provided that two groups of rotary closed contacts 1 and two groups of rotary non-closed contacts 2 are disposed, one rotary closed contact may be disposed on the innermost side, one rotary non-closed contact 2 sleeves the periphery of the previous rotary closed contact, the other rotary closed contact 1 sleeves the periphery of the rotary non-closed contact 2, and the other rotary non-closed contact 2 is disposed on the outermost side in a sleeving manner. During the sleeving process, axial positions of adjacent two contacts are overlapped in the axial direction, to reduce an occupied space in the axial direction as much as possible. Certainly, the sleeving order of the rotary closed contacts 1 and the rotary non-closed contacts 2 needs to be determined according to actual situations, which is not repeated herein.

When the rotary electrical connection assembly provided in this specific embodiment is used, the rotating part is provided with at least one rotary closed contact 1 and at least one rotary non-closed contact 2, the fixed part is provided with at least one fixed closed contact 3 and at least one fixed non-closed contact 4, during the connection process, the rotary closed contacts 1 and the fixed non-closed contacts 4 are electrically connected, the rotary non-closed contacts 2 and the fixed closed contacts 3 are electrically connected, and therefore at least one loop may be formed for providing electric energy for components and parts. In addition, a sleeved manner is used between the rotary closed contacts 1 and the fixed non-closed contacts 4, between the rotary non-closed contacts 2 and the fixed closed contacts 3, between the rotary closed contacts 1 and the rotary non-closed contacts 2, and between the fixed closed contacts 3 and the fixed non-closed contacts 4 separately, i.e., one sleeves the periphery of the other. Therefore, provided that more groups of the rotary non-closed contacts 2, the fixed closed contacts 3, the rotary closed contacts 1 and the fixed non-closed contacts 4 are disposed, the increase of an axial dimension of a device may be avoided, and miniaturization of the device is facilitated.

On the basis of the above embodiments, an axial width of the rotary non-closed contacts 2, an axial width of the rotary closed contacts 1, an axial width of the fixed non-closed contacts 4 and an axial width of the fixed closed contacts 3 may all be the same; and the rotary non-closed contacts 2, the rotary closed contacts 1, the fixed non-closed contacts 4 and the fixed closed contacts 3 axially completely coincide.

Preferably, the rotary non-closed contacts 2, the rotary closed contacts 1, the fixed non-closed contacts 4 and the fixed closed contacts 3 may each have a sheet structure. Therefore, during the assembly process, even if more groups of the rotary non-closed contacts 2, the rotary closed contacts 1, the fixed non-closed contacts 4 and the fixed closed contacts 3 are disposed, the increase of a radial size may not be relatively large.

On the basis of the above embodiments, the rotary non-closed contacts 2 and the fixed non-closed contacts 4 each are an elastic structural member, such that the rotary non-closed contacts 2 are in contact with sides of the fixed closed contacts 3 by elastic force, and the fixed non-closed contacts 4 are in contact with sides of the rotary closed contacts 1 by elastic force.

During the arrangement process, the rotary non-closed contacts 2 may sleeve the periphery of the fixed closed contacts 3, and an inner diameter of the rotary non-closed contacts 2 is made to be less than an outer diameter of the fixed closed contacts 3 matching with the rotary non-closed contacts 2, such that the rotary non-closed contacts 2 are in contact with the fixed closed contacts 3 by elastic force to implement electrical connection. Certainly, the rotary non-closed contacts 2 may further be sleeved with the fixed closed contacts 3, and an outer diameter of the rotary non-closed contacts 2 is made to be greater than an inner diameter of the fixed closed contacts 3, such that the rotary non-closed contacts 2 are in contact with the fixed closed contacts 3 by elastic force to implement electrical connection. The connecting mode between the rotary closed contacts 1 and the fixed non-closed contacts 4 is similar to the connection mode between the rotary non-closed contacts 2 and the fixed closed contacts 3, i.e., the rotary closed contacts 1 may be sleeved with or sleeve the fixed non-closed contacts 4.

On the basis of the above embodiments, for the ease of connection to other members, the rotary closed contacts 1 and the rotary non-closed contacts 2 may each be provided with a first bent part electrically connected to a rotating member, and the fixed non-closed contacts 4 and the fixed closed contacts 3 each are provided with a second bent part electrically connected to a power supply part.

The rotating member has a structure needing to rotate in the hair styling device.

Preferably, the rotary electrical connection assembly further includes a rotating housing 5 configured to wrap the peripheries of the rotary closed contacts 1 and the rotary non-closed contacts 2, and a fixed housing 6 configured to fixedly mount the fixed closed contacts 3 and the fixed non-closed contacts 4.

A central shaft 7 configured to transmit power may further be disposed, the central shaft 7 is driven by a motor 10 to rotate, and the rotary closed contacts 1 and the rotary non-closed contacts 2 in the rotating part are connected to the central shaft 7 and are driven by the central shaft 7 to rotate.

In addition to the rotary electrical connection assembly in the above embodiments, the present invention further provides a rotary tail assembly including the rotary electrical connection assembly disclosed in the above embodiments. Refer to the prior art for the structure of other parts of the rotary tail assembly, which is not repeated herein.

In addition to the rotary electrical connection assembly described above, the present invention further provides a hair styling device including the rotary electrical connection assembly disclosed in the above embodiments or the rotary tail assembly. Refer to the prior art for the structure of other parts of the hair styling device, which is not repeated herein.

On the basis of the above embodiments, the hair styling device may include a rotary part configured to be connected to the rotating part of the rotary electrical connection assembly, and a handheld assembly connected to the fixed part of the rotary electrical connection assembly; and the rotary part includes a heating assembly configured to heat hair, and a cylinder assembly disposed rotatably relative to the handheld assembly.

Preferably, control buttons 8 may be disposed on the handheld assembly.

The control buttons 8 include heating and cooling buttons configured to control heating of the heating assembly, and a power button configured to control power-on and power-off.

As shown in FIG. 3 to FIG. 8, a circuit board 11 is disposed in the handheld assembly of the hair styling device. The motor 10 is connected to the circuit board 11. The motor 10 drives the central shaft 7 to rotate. A limiting bearing 9 sleeves the central shaft 7 and is configured to control a rotating center and an axial position of the rotary part. The central shaft 7 drives the rotary part and the heating assembly to rotate. The rotary part and the heating assembly both need to be connected to the rotary closed contacts 1 and the rotary non-closed contacts 2, and therefore the rotary closed contacts 1 and the rotary non-closed contacts 2 may rotate with the central shaft 7.

It should be noted that "first" and "second" in the first bent parts and the second bent parts mentioned in the file of the present application are merely used to limit a positional difference, rather than a sequential order.

The embodiments in this specification are described in a progressive manner, each embodiment focuses on the difference from other embodiments, and the same and similar parts between the embodiments may refer to each other. Any combination of the embodiments provided in the present invention falls within the protection scope of the present invention, and is not repeated herein.

The foregoing introduces the hair styling device, the rotary tail assembly and the rotary electrical connection assembly provided in the present invention in detail. The principle and implementations of the present invention are described herein through specific examples. The description of the above embodiments is merely used to help understand the method and core ideas of the present invention. It should be noted that a person of ordinary skill in the art may make several improvements and modifications to the present invention without departing from the principle of the present invention, and such improvements and modifications also fall within the protection scope of claims of the present invention.

What is claimed is:

1. A rotary electrical connection assembly, comprising: a fixed part disposed fixedly and a rotating part disposed rotatably relative to the fixed part, at least two rotary contacts being disposed on the rotating part, at least two fixed contacts being disposed on the fixed part, the at least two rotary contacts being located at different radial positions corresponding to the same axial position, and/or the at least two fixed contacts being located at different radial positions corresponding to the same axial position; and the fixed contacts and the rotary contacts being electrically connected wherein the rotating part is provided with an even number of the rotary contacts, and the fixed part is provided with an even number of the fixed contacts; and wherein the rotary contacts comprise at least two rotary closed contacts (1) and at least two rotary non-closed contacts (2), and the fixed contacts comprise at least two fixed closed contacts (3) and at least two fixed non-closed contacts (4); and the rotary closed contacts (1) and the fixed non-closed contacts (4) are electrically connected in a correspondingly sleeved manner, and the rotary non-closed contacts (2) and the fixed closed contacts (3) are electrically connected in a correspondingly sleeved manner.

2. The rotary electrical connection assembly according to claim 1, wherein the rotary closed contacts (1) and the rotary non-closed contacts (2) are disposed in a one-to-one correspondence manner, the rotary closed contacts (1) and the rotary non-closed contacts (2) corresponding thereto are located at different radial positions corresponding to the same axial position, and different rotary closed contacts (1) are located at different axial positions;

and/or the fixed closed contacts (3) and the fixed non-closed contacts (4) are disposed in a one-to-one correspondence manner, the fixed closed contacts (3) and the fixed non-closed contacts (4) corresponding thereto are located at different radial positions corresponding to the same axial position, and different fixed closed contacts (3) are located at different axial positions.

3. The rotary electrical connection assembly according to claim 2, wherein an axial width of the rotary non-closed contacts (2), an axial width of the rotary closed contacts (1), an axial width of the fixed non-closed contacts (4) and an axial width of the fixed closed contacts (3) all are the same; and an axial gap between the rotary closed contacts (1) disposed axially adjacently and an axial gap between the fixed closed contacts (3) disposed axially adjacently are the same.

4. The rotary electrical connection assembly according to claim 3, wherein the rotary non-closed contacts (2) and the fixed non-closed contacts (4) each are an elastic structural member, such that the rotary non-closed contacts (2) are in contact with sides of the fixed closed contacts (3) by elastic force, and the fixed non-closed contacts (4) are in contact with sides of the rotary closed contacts (1) by elastic force.

5. The rotary electrical connection assembly according to claim 3, wherein the rotary non-closed contacts (2), the rotary closed contacts (1), the fixed non-closed contacts (4) and the fixed closed contacts (3) each have a sheet structure.

6. The rotary electrical connection assembly according to claim 3, wherein the rotary closed contacts (1) and the rotary non-closed contacts (2) each are provided with a first bent part electrically connected to a rotating member, and the fixed non-closed contacts (4) and the fixed closed contacts (3) each are provided with a second bent part electrically connected to a power supply part.

7. The rotary electrical connection assembly according to claim 2, wherein the rotary non-closed contacts (2) and the fixed non-closed contacts (4) each are an elastic structural member, such that the rotary non-closed contacts (2) are in contact with sides of the fixed closed contacts (3) by elastic force, and the fixed non-closed contacts (4) are in contact with sides of the rotary closed contacts (1) by elastic force.

8. The rotary electrical connection assembly according to claim 2, wherein the rotary non-closed contacts (2), the rotary closed contacts (1), the fixed non-closed contacts (4) and the fixed closed contacts (3) each have a sheet structure.

9. The rotary electrical connection assembly according to claim 2, wherein the rotary closed contacts (1) and the rotary non-closed contacts (2) each are provided with a first bent part electrically connected to a rotating member, and the fixed non-closed contacts (4) and the fixed closed contacts (3) each are provided with a second bent part electrically connected to a power supply part.

10. The rotary electrical connection assembly according to claim 1, wherein the rotary non-closed contacts (2) and the fixed non-closed contacts (4) each are an elastic structural member, such that the rotary non-closed contacts (2) are in contact with sides of the fixed closed contacts (3) by elastic force, and the fixed non-closed contacts (4) are in contact with sides of the rotary closed contacts (1) by elastic force.

11. The rotary electrical connection assembly according to claim 1, wherein the rotary non-closed contacts (2), the rotary closed contacts (1), the fixed non-closed contacts (4) and the fixed closed contacts (3) each have a sheet structure.

12. The rotary electrical connection assembly according to claim 1, wherein the rotary closed contacts (1) and the rotary non-closed contacts (2) each are provided with a first bent part electrically connected to a rotating member, and the fixed non-closed contacts (4) and the fixed closed contacts (3) each are provided with a second bent part electrically connected to a power supply part.

13. A rotary electrical connection assembly, comprising: a fixed part disposed fixedly and a rotating part disposed rotatably relative to the fixed part, at least two rotary contacts being disposed on the rotating part, at least two fixed contacts being disposed on the fixed part, the at least two rotary contacts being located at different radial positions corresponding to the same axial position, and/or the at least two fixed contacts being located at different radial positions corresponding to the same axial position; and the fixed contacts and the rotary contacts being electrically connected;

wherein the rotating part is provided with an even number of the rotary contacts, and the fixed part is provided with an even number of the fixed contacts; and wherein the rotary contacts comprise at least one rotary closed contact (1) and at least one rotary non-closed contact (2), and the fixed contacts comprise at least one fixed closed contact (3) and at least one fixed non-closed contact (4);

the rotary closed contacts (1) and the fixed non-closed contacts (4) are electrically connected in a correspondingly sleeved manner, and the rotary non-closed contacts (2) and the fixed closed contacts (3) are electrically connected in a correspondingly sleeved manner; and the rotary closed contacts (1) and the rotary non-closed contacts (2) are located at different radial positions corresponding to the same axial position, and the fixed closed contacts (3) and the fixed non-closed contacts (4) are located at different radial positions corresponding to the same axial position.

14. The rotary electrical connection assembly according to claim 13, wherein an axial width of the rotary non-closed contacts (2), an axial width of the rotary closed contacts (1), an axial width of the fixed non-closed contacts (4) and an axial width of the fixed closed contacts (4) all are the same; and the rotary non-closed contacts (2), the rotary closed contacts (1), the fixed non-closed contacts (4) and the fixed closed contacts (3) axially completely coincide.

15. The rotary electrical connection assembly according to claim 14, wherein the rotary non-closed contacts (2) and the fixed non-closed contacts (4) each are an elastic structural member, such that the rotary non-closed contacts (2) are in contact with sides of the fixed closed contacts (3) by elastic force, and the fixed non-closed contacts (4) are in contact with sides of the rotary closed contacts (1) by elastic force.

16. The rotary electrical connection assembly according to claim 14, wherein the rotary non-closed contacts (2), the rotary closed contacts (1), the fixed non-closed contacts (4) and the fixed closed contacts (3) each have a sheet structure.

17. The rotary electrical connection assembly according to claim 13, wherein the rotary non-closed contacts (2) and the fixed non-closed contacts (4) each are an elastic structural member, such that the rotary non-closed contacts (2) are in contact with sides of the fixed closed contacts (3) by elastic force, and the fixed non-closed contacts (4) are in contact with sides of the rotary closed contacts (1) by elastic force.

18. The rotary electrical connection assembly according to claim 13, wherein the rotary non-closed contacts (2), the rotary closed contacts (1), the fixed non-closed contacts (4) and the fixed closed contacts (3) each have a sheet structure.

* * * * *